US007980790B2

(12) United States Patent
Taylor et al.

(10) Patent No.: US 7,980,790 B2
(45) Date of Patent: Jul. 19, 2011

(54) COMPRESSIBLE MECHANICALLY STABILIZED EARTH RETAINING WALL SYSTEM AND METHOD FOR INSTALLATION THEREOF

(75) Inventors: Thomas P. Taylor, Euless, TX (US); James Scott Bagwell, Arlington, TX (US)

(73) Assignee: T & B Structural Systems, Inc., Ft. Worth, TX (US)

( * ) Notice: Subject to any disclaimer, the term of this patent is extended or adjusted under 35 U.S.C. 154(b) by 0 days.

(21) Appl. No.: 12/269,922

(22) Filed: Nov. 13, 2008

(65) Prior Publication Data

US 2009/0067933 A1 Mar. 12, 2009

Related U.S. Application Data

(63) Continuation of application No. 10/997,578, filed on Nov. 24, 2004, now abandoned.

(60) Provisional application No. 60/525,521, filed on Nov. 26, 2003.

(51) Int. Cl.
*E02D 17/20* (2006.01)

(52) U.S. Cl. ..... 405/284; 405/302.7

(58) Field of Classification Search ..... 405/262, 405/284, 302.4, 302.6, 302.7
See application file for complete search history.

(56) References Cited

U.S. PATENT DOCUMENTS

| | | | | |
|---|---|---|---|---|
| 4,391,557 | A * | 7/1983 | Hilfiker et al. | 405/287 |
| 4,643,618 | A * | 2/1987 | Hilfiker et al. | 405/287 |
| 4,856,939 | A * | 8/1989 | Hilfiker | 405/284 |
| 5,531,547 | A * | 7/1996 | Shimada | 405/262 |
| 5,733,072 | A * | 3/1998 | Hilfiker et al. | 405/284 |
| 5,951,209 | A * | 9/1999 | Anderson et al. | 405/262 |
| 6,357,970 | B1 * | 3/2002 | Hilfiker et al. | 405/302.7 |

* cited by examiner

*Primary Examiner* — Sunil Singh
(74) *Attorney, Agent, or Firm* — Edmonds & Nolte, PC

(57) ABSTRACT

A compressible mechanically stabilized earth retaining wall system and installation thereof is described.

19 Claims, 4 Drawing Sheets

COMPRESSIBLE MECHANICALLY STABILIZED EARTH RETAINING WALL SYSTEM AND METHOD FOR INSTALLATION THEREOF

CROSS REFERENCE

This application is a continuation of U.S. application Ser. No. 10/997,578 filed Nov. 24, 2004, now abandoned, which claims priority from U.S. Provisional Patent Application Ser. No. 60/525,521, filed on Nov. 26, 2003, and hereby incorporated by reference in its entirety.

BACKGROUND

Current earth reinforcing systems are used during the creation of roadways and other projects to stabilize, for example, soil and other materials. However, many current systems use modular elements that are fastened together to form a reinforcing structure. The modular elements may shift with respect to one another, which creates binding and may damage the integrity of the reinforcing structure. In addition, such structures often create an axial force on the underling elements when the material being reinforced is compressed.

Accordingly, what is needed is a system and method for addressing these and similar issues.

WRITTEN DESCRIPTION

Figure 1:
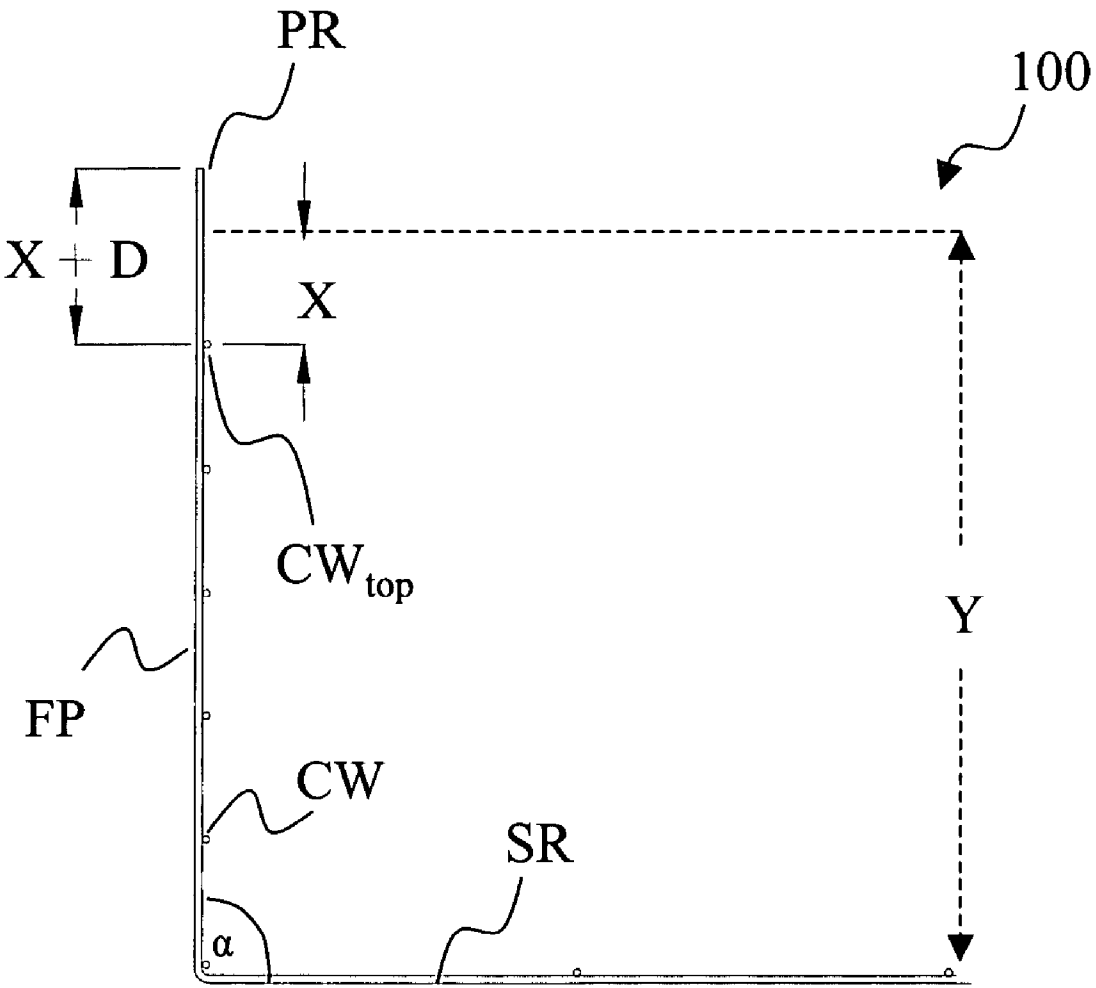
FIG. 1 is a side view of one embodiment of a retaining element that may be used in a retaining wall system.

The present disclosure is directed to a system and method for reinforcing earth walls and, more specifically, to a system and method of constructing a mechanically stabilized earth welded wire wall with a series of soil reinforcing elements and facing panels that do not bear on the facing panel of the lower elements, but bear on the reinforced backfill zone while allowing the facing panels to be integrated with the soil reinforcing elements above.

It is understood that the following disclosure provides many different embodiments, or examples, for implementing different features of the disclosure. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

For purposes of illustration, the mechanically stabilized earth wall structures in the following examples comprise elements of welded wire mesh. The welded wire mesh is formed into an L-shaped element that has a horizontal welded wire mesh section (e.g., the bottom of the L) that is buried in the soil and a vertical welded wire mesh section (e.g., the leg of the L) that is placed against the soil to prevent raveling of the soil between successive rows of soil reinforcing. In one embodiment, the L-shaped element is fabricated by folding a portion of a substantially planar element approximately ninety degrees.

The vertical welded wire mesh section defines the face of the earthen formation. The welded wire mesh is fabricated with a series of vertical wires that have a series of cross wires (e.g., horizontal wires) attached thereto. The top-most cross wire is positioned below the ends of the vertical wires so that vertical wires have distal ends that extend above the top-most cross wire. The overall length from the fold line (where the mesh is bent) to the distal ends is larger than the distance of the center-to-center spacing of the soil reinforcing within the mechanically stabilized earth mass, as will be described below. The top-most cross wire is positioned a distance "X" below the required elevation of the next row of soil reinforcing. The distance X may be defined as the distance of allowable consolidation, compression, or settlement of the earthen mass between the horizontal portions of the soil reinforcing elements.

As will be described later in greater detail with respect to a particular embodiment, the retaining structure may be constructed as follows. First, an L-shaped element is placed on a prepared foundation and backfill is placed on the horizontal section of the element and compacted to an elevation that provides a desired vertical spacing of the elements. A wedge shaped void is left at the back face of the face panel of the L-shaped element. Another L-shaped element is placed over the distal ends of the face panel of the lower, previously positioned L-shaped element. The distal ends of the lower L-shaped element's face panel are placed behind the face panel and through the mesh of the horizontal section of the top L-shaped element. The horizontal portion of the higher L-shaped element is completely supported by the backfill and is not in contact with any cross element of the soil reinforcing face panel below. The backfill supports the soil-reinforcing element above and prevents the top L-shaped element from bearing on the face panel below. This step is repeated until the elevation desired for the retaining structure is reached. A cap mat comprising planar welded wire mesh elements may then be placed horizontally over the top L-shaped element. The cap mat is placed over the distal ends of the vertical section of the top L-shaped element, and may or may not be in contact with the cross wire of the upper most vertical face panel.

Referring to FIG. 1, in one embodiment, an L-shaped welded wire grid element 100 (e.g., a wire mesh panel) is illustrated. The L-shaped element 100 includes a substantially horizontal soil-reinforcing element (SR) and a substantially vertical face panel (FP). It is understood that the use of the terms "horizontal" and "vertical" are for purposes of illustration only, and that the soil-reinforcing element and the face panel may be oriented in many different ways. Furthermore, while the face panel is illustrated as being at an angle $\alpha$ of approximately ninety degrees from the soil-reinforcing panel, it is understood that the angle $\alpha$ may be any angle between approximately 1 and 180 degrees. Accordingly, the term "L-shaped" should not be interpreted to limit the shape of the element 100.

Attached to the vertical face panel are cross wires (CW) (e.g., the horizontal wires of the mesh panel). The center-to-center vertical spacing of the L-shaped element 100 with respect to other L-shaped elements (FIG. 3) is set at dimension Y. The top-most cross wire, $CW_{top}$, of the vertical face panel is set a distance "X" below the center-to-center spacing of the L-shaped element. The distance X may be defined as the compressibility range of the center-to-center spacing of the L-shaped element, as will be described later in greater detail. The distal ends, PR, of the vertical wires of the vertical face panel are a distance equal to X+D from $CW_{top}$, where D is defined as the distance that the distal ends extend above the vertical center-to-center (Y) spacing of an L-shaped element that is positioned above the element 100.

Figure 2:
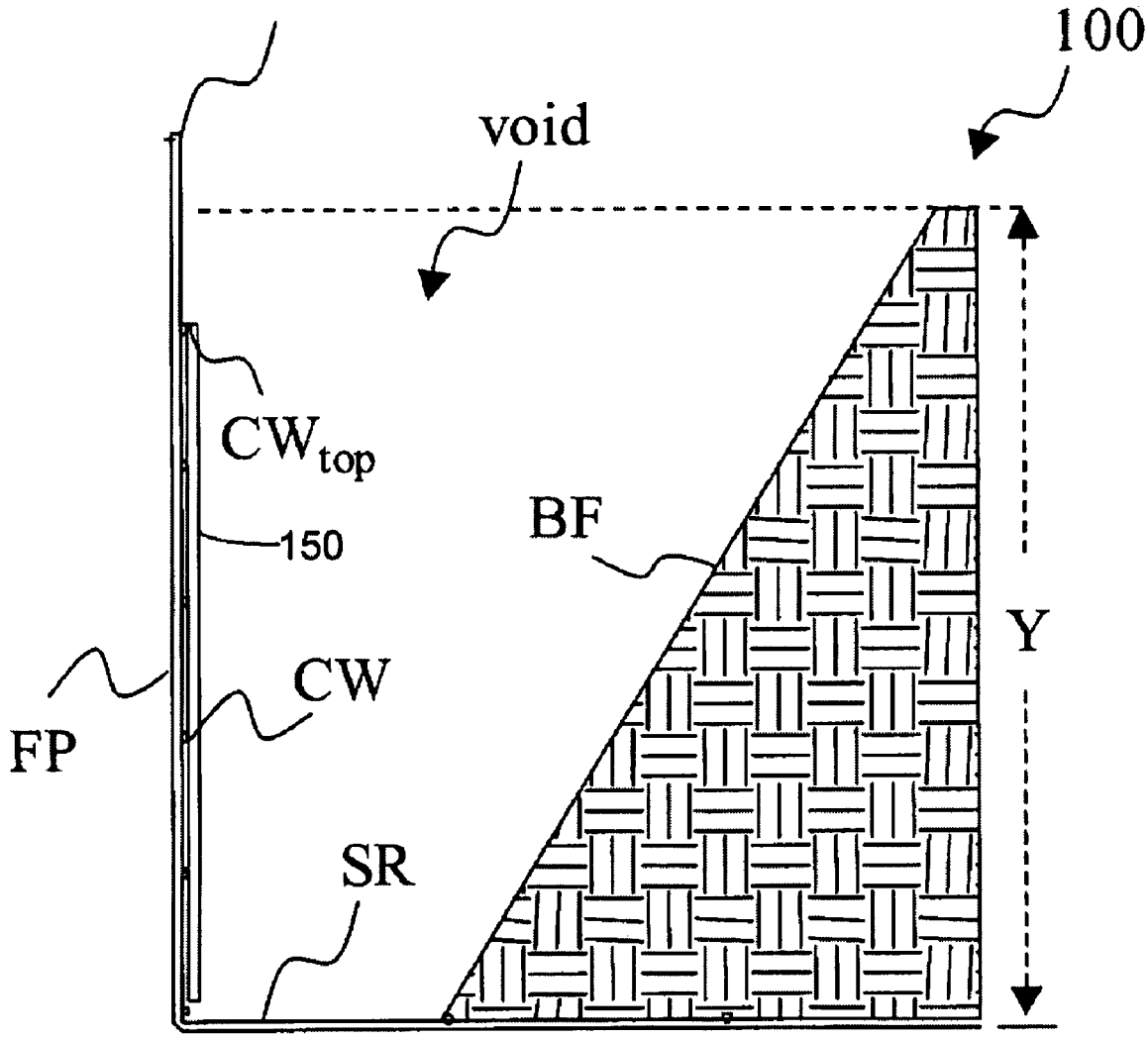
FIG. 2 is a side view of the retaining element of FIG. 1 with a portion of the element covered by backfill.
Figure 3:
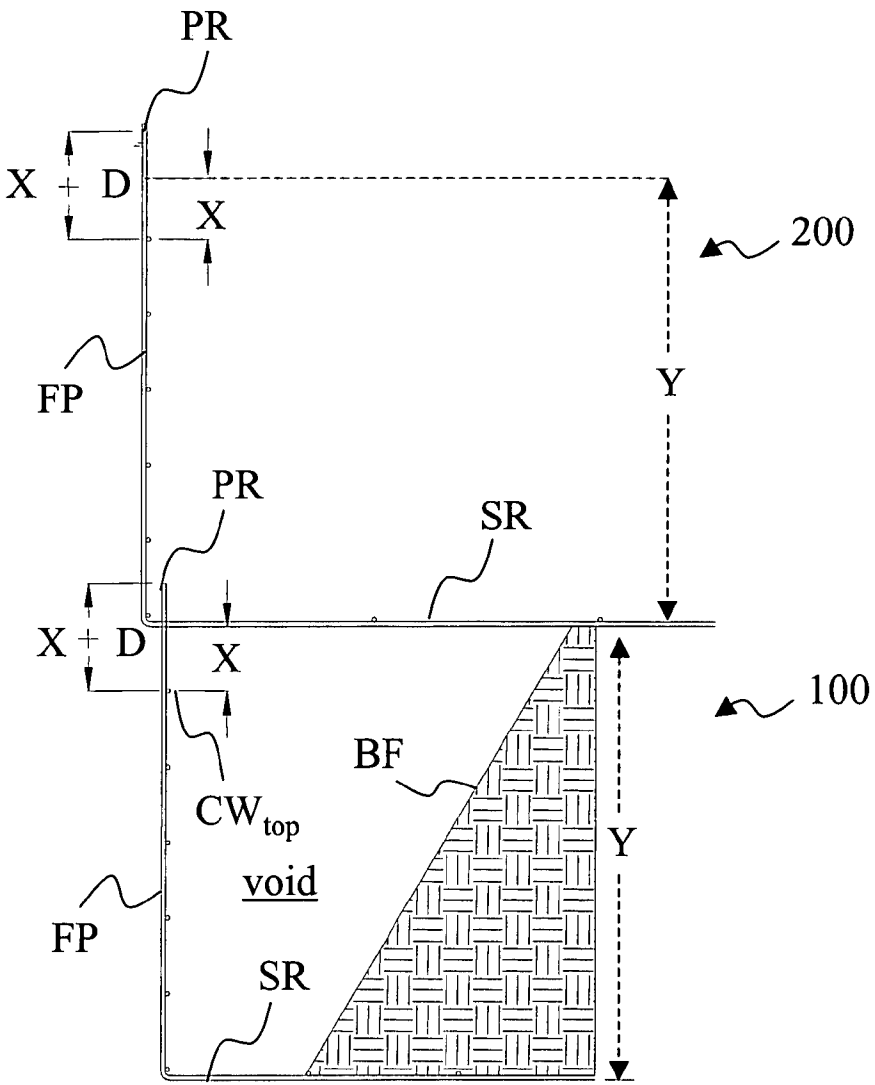
FIG. 3 is a side view of the retaining element of FIG. 1 with another retaining element positioned above it.
Figure 4:
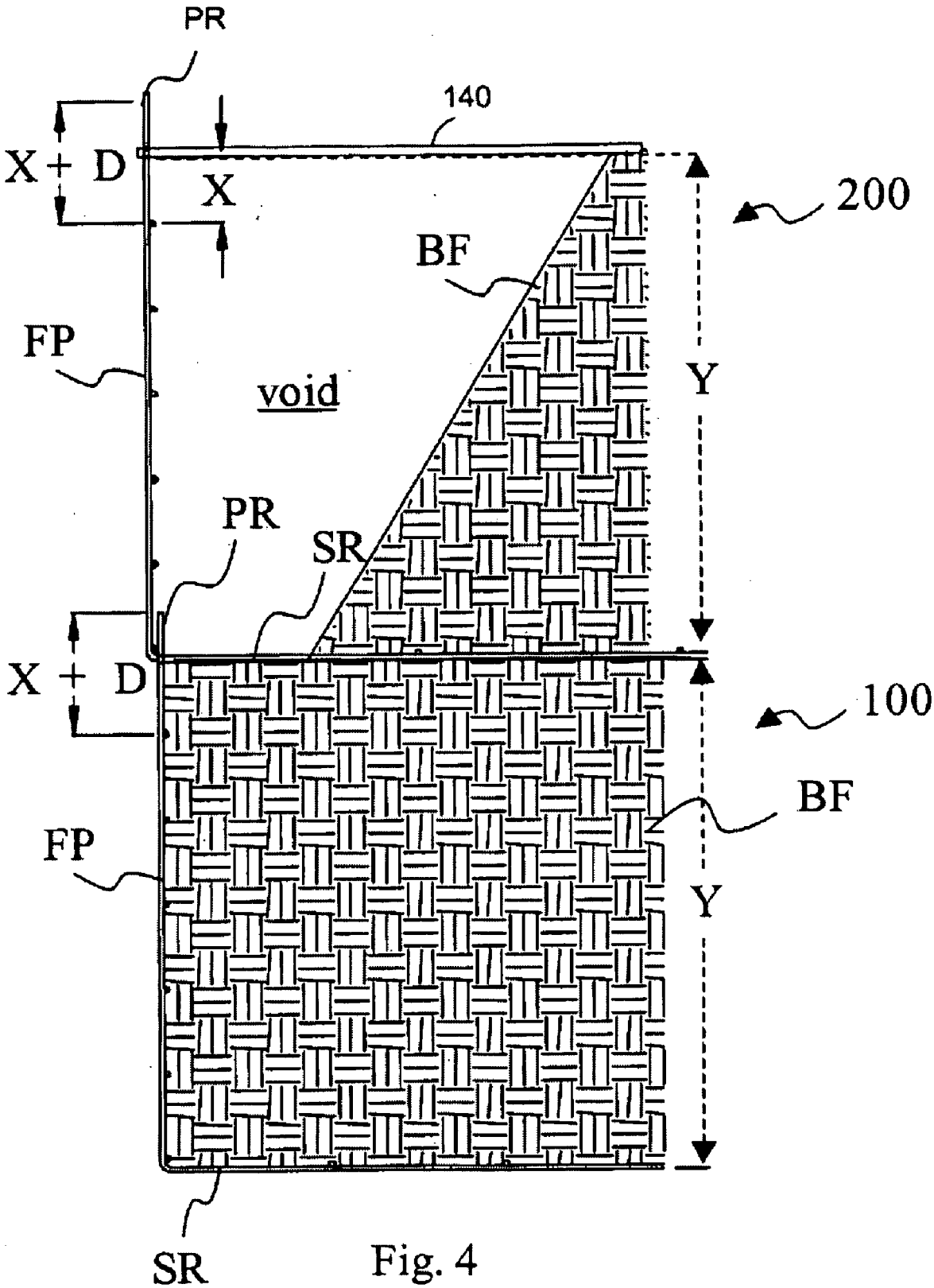
FIG. 4 is a side view of the elements of FIG. 3 with the lower element completely covered and the upper element partially covered.

FIGS. 2-4 illustrate various stages of one embodiment of the construction of a mechanically stabilized earth structure (e.g., a retaining wall). The construction may be described in three basic steps: a beginning step, an intermediate step, and an ending step, each of which is described below in greater detail with respect to a particular figure. These steps may be repeated as needed until the desired structure has been created.

Referring to FIG. 2, the beginning step of constructing the retaining wall involves placing the L-shaped element 100 on a prepared foundation. More specifically, the horizontal soil-reinforcing element, SR, is placed on the prepared foundation. The backfill (BF) is then placed and compacted to the required thickness, Y, which is equal to the center-to-center spacing of the L-shaped element. This compacted backfill forms a reinforced support at the proper height at which another L-shaped element may be placed without directly contacting the L-shaped element 100. It is noted that the distal end, PR, is above the center-to-center spacing of the L-shaped element, Y. The backfill is placed and compacted so as to create a wedge-shaped void at the face of the L-shaped element 100.

Referring to FIG. 3, the intermediate step of constructing the retaining wall comprises placing an L-shaped element 200 onto the backfill (FIG. 2) to form the next layer of the retaining wall. The L-shaped element 200 is placed so that it is supported by the compacted backfill, BF, at a distance X from $CW_{top}$ of the vertical facing panel of the L-shaped element 100. The L-shaped element 200 is positioned so that the distal ends, PR, of the L-shaped element 100 penetrate the mesh forming the horizontal soil-reinforcing element SR of the L-shaped element 200. In the present example, the distal ends PR of the L-shaped element 100 are positioned behind the facing panel, FP, of the L-shaped element 200. Accordingly, the horizontal soil-reinforcing element SR of the L-shaped element 200 is supported by the backfill below it and is not in contact with any cross element of the L-shaped element 100. The backfill supports the horizontal soil-reinforcing element SR of the L-shaped element 200 and does not bear on the vertical face panel of the L-shaped element 100 below. The L-shaped elements 100 and 200 are not fastened together, which enables them to move relative to one another without binding as the backfill is compressed. However, their relative movement is constrained by the positioning of the distal ends, PR, of the L-shaped element 100 through the mesh forming the horizontal soil-reinforcing element SR of the L-shaped element 200. It is understood that the backfill may compress various distances between X (no compression) and $CW_{top}$ (full compression). However, in the present embodiment, it is desirable that the backfill remain at least slightly above $CW_{top}$ so that the L-shaped element 200 does not rest on $CW_{top}$ of the L-shaped element 100.

Referring now to FIG. 4, once the L-shaped element 200 is placed on the backfill and pulled into the desired horizontal alignment, backfill is placed on the tail of the horizontal soil-reinforcing element SR of the L-shaped element 200, which anchors the L-shaped element 200 and keeps it from moving. In addition, backfill is placed into the void of the L-shaped element 100 to fill in the wedge. During the filling of the void, the elevation of the horizontal soil-reinforcing element SR of the L-shaped element 200 may be monitored to maintain a substantially horizontal relationship and to keep the distance X substantially uniform.

This process may be repeated (e.g., the processes of FIGS. 2-4 may be repeated sequentially or the process illustrated by a single FIGURE may be repeated) until the elevation of the desired structure is achieved and a cap mat 140 (shown in FIG. 4) may be installed, which is the ending step of the construction process in the present example. The cap mat 140 comprises one or more horizontally oriented welded wire mesh elements that are placed over the distal ends PR of the vertical face panels of the uppermost L-shaped elements (e.g., the L-shaped element 200 in FIG. 4). The cap mat 140 may or may not be in contact with $CW_{top}$ of the vertical face panel of the L-shaped element 200.

It is understood that the L-shaped elements 100 and 200 may not be directly vertical to one another, but may be staggered. For example, the L-shaped element 200 may be placed with only half of its horizontal soil-reinforcing element SR above the L-shaped element 100, while the other half is above another L-shaped element (not shown). Multiple L-shaped elements may therefor be combined into various configurations as needed.

In another embodiment, an improved method of constructing a compressible mechanically stabilized earth welded wire retaining wall may include the following. The method includes providing a substantially L-shaped welded wire mesh element with a horizontal portion defining a soil reinforcing section and a vertical portion defining a face panel. The face panel contains a series of vertical wires that are interconnected by a series of horizontal cross wires, where the top-most cross wire is a distance "X" below the elevation of the center-to-center spacing of the soil reinforcing elements. The distance X may be defined as the compressibility distance. The vertical wires of the face panel include distal ends that extend above the top-most cross wire farther than the compressibility distance "X." The horizontal wires are vertically spaced within the reinforced mass.

The method includes placing backfill on the soil reinforcing section of an L-shaped element and compacting the backfill to an elevation equal to a desired center-to-center spacing of the L-shaped elements. Another layer is then added by placing another L-shaped welded wire mesh element onto the lower L-shaped element. The top L-shaped element is placed so that the horizontal section defining the soil reinforcing portion and the face panel are placed on and are supported by the backfill. The distal ends of the face panel below are placed through the welded wire mesh horizontal openings of the overlaying horizontal section near the back face of the vertical face panel of the L-shaped element above. Furthermore, the horizontal section is placed on and supported by the backfill at the distance X from the top-most cross wire of the vertical face panel of the L-shaped element below and does not bear on the face panel below.

In one embodiment, the facing panel contains uniformly spaced vertical wires and uniformly spaced cross wires that create a grid as viewed from the front face of the structure that has an apparent opening of uniform dimensions.

In another embodiment, the facing panel contains uniformly spaced vertical wires and uniformly spaced cross wires. Attached to the back face of the face panel is a backing mat 150 (as shown in FIG. 2 containing uniformly spaced vertical wires and uniformly spaced cross wires that span the center-to-center spacing of the face panel's vertical and cross wires to create a grid as viewed from the front face of the structure that has an apparent opening of uniform dimensions that are equal to one half the size of the apparent opening of the facing panel. In some embodiments, a mesh of smaller apparent openings may be used to prevent fine material from passing through the face of the structure.

In yet another embodiment, the backing mat 150 contains distal ends of the same length as those of the face panel. In another embodiment, the backing mat 150 spans more than one L-shaped element. In still another embodiment, the backing mat's top-most cross wire is at the same elevation as the top-most cross wire of the face panel.

While the preceding description shows and describes one or more embodiments, it will be understood by those skilled in the art that various changes in form and detail may be made therein without departing from the spirit and scope of the present disclosure. For example, various steps of the described methods may be executed repetitively, combined, further divided, replaced with alternate steps, or removed entirely. In addition, different shapes and sizes of elements may be combined in different configurations to achieve desired earth retaining structures. Therefore, the claims should be interpreted in a broad manner, consistent with the present disclosure.

What is claimed is:

1. A system using wire mesh elements formed of vertical and horizontal wires for reinforcing soil, the system comprising:

a first wire mesh element having a first bend formed therein at a first angle to form first and second panels, wherein the second panel is oriented substantially horizontally and each vertical wire of the first panel extends upward from the second panel at the first angle and continues upward at the first angle until terminating at a distal end disposed at the first angle, and wherein a top-most horizontal wire of the first panel is at least a distance D+X from the distal end of each vertical wire; and a second wire mesh element having a second bend formed therein at a second angle to form third and fourth panels, wherein the fourth panel is oriented substantially horizontally and each vertical wire of the third panel extends upward from the fourth panel at the second angle and terminates at a distal end disposed at the second angle, wherein the second element is completely supported by backfill placed on only a portion and not covering all of the second panel, the backfill generating a void between the backfill and the first panel, and wherein the second element is positioned above the first element so that at least a portion of the vertical wires of the first panel penetrate the fourth panel to at least the distance D when the second panel is covered with backfill to a height of X above the top-most horizontal wire of the first panel, wherein X represents a maximum distance separating the top-most horizontal wire of the first panel from the fourth panel, and wherein the first and second elements are not in contact with each other, but may move vertically and laterally relative to one another as the value of X decreases due to compression of the backfill.

2. The system of claim 1 wherein the vertical wires of the first panel penetrate the fourth panel proximate to the second bend.

3. The system of claim 1 wherein a value of X is determined based on properties of the backfill.

4. The system of claim 1 wherein the vertical and horizontal wires of the first panel are uniformly spaced to create a grid that has an apparent opening of uniform dimensions.

5. The system of claim 1 further comprising a backing mat attached to the first panel, wherein the backing mat includes a plurality of substantially uniformly spaced vertical and horizontal wires that create a grid with openings smaller than the openings formed by the vertical and horizontal wires of the first panel.

6. The system of claim 1 further comprising a substantially planar cap mat placed horizontally over the second L-shaped element, wherein the cap mat comprises a mesh fowled of a plurality of vertical and horizontal wires.

7. The system of claim 1 wherein the first and second angles are identical.

8. The system of claim 1 wherein the first and second angles are different.

9. The system of claim 1 wherein the second and fourth panels are substantially parallel.

10. A method for constructing a mechanically stabilized earth welded wire soil-reinforcing system using a plurality of wire mesh L-shaped grids each having a substantially horizontal wire mesh soil reinforcing (SR) element and a face panel extending upwards from the SR element at an angle $\alpha$, wherein each face panel includes horizontal wires and vertical wires having distal ends that extend a distance D beyond the top-most horizontal wire, the method comprising:

placing material on only a portion and not covering all of a first SR element of a first L-shaped grid, wherein a first void is generated between the material and a first face panel of the first L-shaped grid;

positioning a second L-shaped grid above the first L-shaped grid, wherein positioning of the second L-shaped grid includes:

resting at least a part of a second SR element of the second L-shaped grid on the material, wherein the second SR element of the second L-shaped grid is completely supported by the material;

placing at least some of the distal ends of the vertical wires of the first face panel through the wire mesh of the second SR element and proximate to a back face of a second face panel of the second SR element, each vertical wire extending at the angle $\alpha$ until terminating at a distal end, wherein the second SR element is supported by the material at a distance X from the top-most horizontal wire of the first face panel and does not bear on the first face panel, and wherein the first and second L-shaped grids are not in contact with each other but may move vertically and laterally relative to one another as the value of X decreases due to compression of the material.

11. The method of claim 10 further comprising:

placing material on only a portion and not covering all of the second SR element, wherein a second void is generated left between the material and the second face panel of the second L-shaped grid; and filling the first void between the material and the first face panel of the first L-shaped grid using the material.

12. The method of claim 11 further comprising monitoring the filling of the first void to ensure that the second SR element remains substantially horizontal.

13. The method of claim 11 further comprising monitoring the filling of the second void to ensure that the second SR element remains substantially parallel to the first SR element.

14. The method of claim 10 further comprising calculating the distance X based on a compressibility of the material.

15. The method of claim 10 further comprising attaching a backing mat to the first face panel, wherein the backing mat includes a plurality of substantially uniformly spaced vertical and horizontal wires that create a grid with openings smaller than the openings formed by the vertical and horizontal wires of the first face panel.

16. The method of claim 10 further comprising placing a substantially planar cap mat horizontally over the second L-shaped grid, wherein the cap map comprises a mesh formed of a plurality of vertical and horizontal wires.

17. The method of claim 10 further comprising calculating the angle $\alpha$ for each of the first and second L-shaped grids, wherein each angle $\alpha$ is calculated based on a desired shape of the soil-reinforcing system.

18. The method of claim 17 wherein the calculated angles are identical.

19. The system of claim 17 wherein the calculated angles are different.

* * * * *